United States Patent [19]

Wygant

[11] 3,994,816

[45] Nov. 30, 1976

[54] POWER TRANSMISSION USING SYNTHETIC FLUIDS

[75] Inventor: James C. Wygant, Creve Coeur, Mo.

[73] Assignee: Monsanto Company, St. Louis, Mo.

[22] Filed: Mar. 22, 1976

[21] Appl. No.: 669,130

Related U.S. Application Data

[63] Continuation-in-part of Ser. No. 549,648, Feb. 13, 1975, abandoned, which is a continuation of Ser. No. 84,222, Oct. 26, 1970, abandoned.

[52] U.S. Cl. ..... 252/73

[51] Int. Cl.[2] ..... C10M 3/10

[58] Field of Search ..... 252/73, 59

[56] References Cited

UNITED STATES PATENTS 3,577,361 5/1971 Hammann et al. ..... 252/73

*Primary Examiner*—Harris A. Pitlick

*Attorney, Agent, or Firm*—William H. Duffey

[57] ABSTRACT

An improved method of transmitting power in hydraulically-operated mechanisms which comprises using as the operative fluid substantially completely hydrogenated dimers of alpha-methylstyrene, e.g. 2,4-dicyclohexyl-2-methylpentane.

4 Claims, No Drawings

POWER TRANSMISSION USING SYNTHETIC FLUIDS

This is a continuation-in-part of application Ser. No. 549,648 filed Feb. 13, 1975 and now abandoned, which is a continuation of application Serial No. 84,222 filed Oct. 26, 1970, the latter now abandoned.

BACKGROUND OF THE INVENTION

1. Field of the Invention

This invention relates to improvements in the transmission of power in mechanical devices. More specifically, it relates to the use of superior synthetic hydrocarbon fluids in apparatus in which mechanical forces are transmitted or absorbed by the fluid, e.g., in automotive transmissions, hydraulic systems, shock absorbers, hydraulic steering mechanisms, clutches and other hydraulically operated devices.

2. Description of the Prior Art

Along with the development of various mechanisms for transmitting power has arisen the need for suitable fluids which perform essential functions in the operation of these mechanisms. Operation of these complex mechanisms often requires that the fluid function in several different capacities. The fluid not only serves as a lubricant and coolant in reducing the friction and heat developed during operation of the mechanism, but also performs other key functions. In the case of automatic transmissions for automotive vehicles, for example, the fluid functions hydrokinetically in the fluid coupling or torque converter, depending upon the type of transmission, and in the hydraulic operation of the various mechanical components of the driving unit.

In most hydraulic systems the hydraulic fluid must lubricate the frictional parts of the system in addition to performing the primary function of transmitting power. The parts which are so lubricated include the frictional surfaces of the fluid pump, operating pistons, cylinders, valves and fluid motors. Many of these components are complex mechanical devices.

Conventional automatic transmissions, industrial hydraulic systems, gear reducers, and the like, generally employ functional fluids having base stocks selected from naturally occurring oils of mineral origin. It is well-known, however, that such mineral oils, even upon subsequent refining, do not possess the characteristics which enable them to perform satisfactorily in such demanding applications. Thus, it is a general practice to add small amounts of other materials to these base stocks to affect one or more of the properties thereof. Because of increasing performance requiements imposed on many functional fluids, however, it has become difficult to find additives which will still perform the functions for which they are added and yet not introduce other problems such as increasing corrosion and causing harmful deposits.

The useful life of any functional fluid can generally be adjudged on the basis of criteria such as the extent of viscosity increase, the extent of corrosion to metal surfaces in contact with the fluid, and the extent of deposits. Modern automatic transmissions are illustrative of a rigorous environment where the useful life of the working fluid is of great importance. The requirements placed on automatic transmission fluids have become more severe in recent years as the horsepower of new automobiles has increased. At the same time, there has been an effort to lengthen the recommended interval between transmission oil changes. Oxidation stability requirements have become especially critcal. Sludge and varnish formation, which are symptomatic of oxidation, create serious operating problems in the complex mechanisms of the transmission.

Modern fluids for automatic transmissions, therefore, employ highly refined mineral oil base stocks with multipurpose additive packages incorporated therein. Even the most modern formulated mineral oils, however, are often marginal in long term performance when subjected to the thermal and oxidative stresses found in today's automatic transmissions for motor vehicles.

Synthetic hydrocarbon base stocks offer the potential for creating fluids which are vastly superior to mineral oil base stocks in oxidative stability and long term performance. Many synthetic fluids however, are found to cause corrosion when brought into contact with common materials, and others have been disqualified because of unsuitable viscosity properties.

It is accordingly an object of the present invention to provide a synthetic fluid having outstanding oxidation resistance and desirable viscosity properties.

Another object of this invention is to provide an improved method of transmitting power through use of superior synthetic fluids.

Still another object of the present invention is to provide an improved method of operating an automatic transmission by the use of a synthetic hydrocarbon which has superior oxidative stability and desirable viscosity properties.

SUMMARY

The synthetic fluids employed to transmit power in accordance with this invention comprise substantially completely hydrogenated dimers of alpha-alkyl styrene and ring substituted alkyl-alpha-alkyl styrene. Hydrogenated linear dimers of such alpha-alkyl styrenes which comprise the major proportion of the synthetic fluid are defined by the following structure:

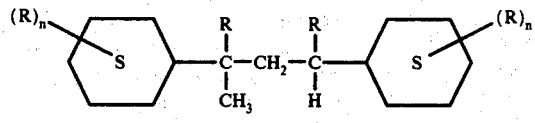

(I)

wherein each R is an alkyl of from 1 to about 4 carbon atoms and $n$ is a whole number from 0 to 2.

Corresponding hydrogenated cyclic dimers of such alpha-alkyl styrene which may be present in minor proportions of up to about 20% by weight of the synthetic fluid are defined by the following structure:

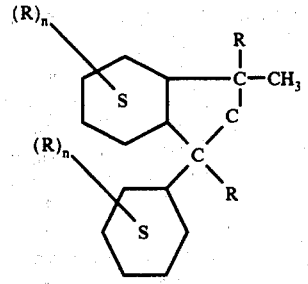

(II)

wherein R and $n$ are as defined above.

Base stocks for power transmission equipment comprising the above synthetic fluids are characterized by having exceptional oxidative stability, excellent viscosity properties over a wide temperature range. The fluids are compatible with conventional viscosity index improvers, and the viscosity of the fluid can accordingly be controlled to suit the requirements of the particular application. The fluids are particularly well suited for use in automatic transmissions and as hydraulic fluids for power steering mechanisms and the like.

DESCRIPTION OF PREFERRED EMBODIMENTS

The synthetic fluids of this invention comprise hydrogenated dimers of alpha-alkyl styrene and ring substituted alkyl-alpha-alkyl styrene. The hydrogenated linear dimers are found to have somewhat better viscosity properties and greater oxidative stability than the hydrogenated cyclic dimers, and are accordingly the preferred compositions. Minor proportions of cyclic dimers which naturally form during the dimerization reaction can be tolerated without serious adverse affect on either viscosity or oxidative stability. In general, it preferred that the synthetic fluids contain less than about 20% of the cyclic dimers, and more preferably less than about 10% by weight of the fluid, although concentration in excess of 20% can be tolerated in applications where low temperature viscosity is not a critical limitation, e.g., certain hydraulic fluids.

Although the alkyl group of the alpha-alkyl styrene can be from 1 to about 4 carbon atoms, it is generally preferred that this alkyl group be methyl or ethyl. The preferred synthetic fluids of this invention are accordingly hydrogenated linear dimers of alpha-methylstyrene and alpha-ethylstyrene, hydrogenated linear codimers of alpha-methylstyrene and alpha-ethylstyrene, and mixtures thereof.

A particularly preferred fluid for purposes of the present invention is the hydrogenated linear dimer of alphamethylstyrene, 2,4-dicyclohexyl-2-methylpentane. Data are presented hereinafter to illustrate the superior oxidative stability of 2,4-dicyclohexyl-2-methylpentane when compared to one of the best mineral oil base fluid formulations currently employed in automatic transmissions.

By way of example, other hydrogenated linear dimer fluids defined by Structure I and included within the scope of the present invention are 2,4-dicyclohexyl-2-methylhexane, 3,5-dicyclohexyl-3-methylhexane, 3,5-dicyclohexyl-3-methylheptane, and 2,4-di(4-methylcyclohexyl)-2-methylpentane. Also within the scope of the present invention are the cyclic dimers defined by Structure II which correspond to the linear dimers enumerated above and are usually formed as coproducts of the dimerization reaction.

Conventional automatic transmission fluids are usually based on hydrocarbon oils which are generally paraffinic in nature. The additive package incorporated in the base stock is designed to accomplish numerous effects. Many of the additives within the package are multifunctional, and it is therefore not always necessary to use a separate additive for each purpose. The usual types of additives found in automatic transmission fluids are oxidation inhibitors, dispersants, metal deactivators, viscosity index improvers, antiwear agents, rust inhibitors, corrosion inhibitors, foam inhibitors, seal swellers and friction modifiers.

Physical conditions in the modern automatic transmission are conducive to oxidation of the working fluid. The rapid flow of fluid through the unit which brings fluid and air into intimate contact, high fluid temperatures and the catalytic effect of the various metals all combine to accelerate oxidation. The result of uncontrolled oxidation is the formation of varnish, sludge and organic acids, the latter being potentially corrosive to metal components. In addition, the fluid may thicken excessively and adversely affect performance.

A well known qualification standard for automatic transmission fluids is identified as "General Motors Standards for Automatic Transmission Fluid, Type A Suffix A". Because newer transmissions and higher output engines have placed greater demands on the transmission fluid, the General Motors Corporation developed a new fluid specification called "Dexron" which is the successor to the Type A Suffix A specification.

The Dexron type fluid, employed herein as a reference for comparison with 2,4-dicyclohexyl-2-methylpentane, was a mineral base hydrocarbon containing an additive package conforming to the Dexron specification. The 2,4-dicyclohexyl-2-methylpentane contained about 3% by weight of the corresponding cyclic dimer and 1% of 2,6-di-t-butyl-p-cresol, an oxidation inhibitor. Oxidation inhibitors are conventionally added to synthetic base stock fluids to further enhance their stability. Examples of suitable inhibitor include hindered phenols such as utilized herein, aromatic secondary amines such as phenyl-alpha-naphthylamine, and organometallic compounds such as dilauryl selenide.

To illustrate the superior oxidative stability of 2,4-dicyclohexyl-2-methylpentane over the reference Dexron fluid, an oxidation and corrosion test was conducted according to the basic procedure set forth in Federal Test Method Standard 791-5308, under the specific test conditions defined below. In general, this test measures increase in fluid viscosity and acidity, change in physical appearance of the fluid and metal corrosion, after exposure for a given period at a constant temperature to a flow of dry air.

The following Tables I, II, III and IV present comparative oxidation and corrosion performance of the reference Dexron fluid and a preferred synthetic fluid of the present invention, viz., 2,4-dicyclohexyl-2-methylpentane. Test conditions for the data of Tables I through IV were as follows:

| | |
|---|---|
| Sample Size | 120 cc. |
| Air Flow | 5 liters/hr. of dry air |
| Temperature | 350° F. (177° C.) |
| Exposure Time | 72 hours |
| Metals Present | Al, Cu, Fe, Mg. |

TABLE I

| | ACIDITY | |
|---|---|---|
| FLUID | INITIAL T.A.N. | FINAL T.A.N. |
| Dexron Fluid | 1.70 | 6.1 |
| 2,4-dicyclohexyl-2-methylpentane | 0.01 | 0.17 |

TABLE II

| FLUID | 100° F. VISCOSITY INCREASE INITIAL VISCOSITY-CS. | FINAL VISCOSITY-CS. | % VISCOSITY INCREASE |
|---|---|---|---|
| Dexron Fluid | 39.08 | 72.22 | 87 |
| 2,4-dicyclohexyl-2-methylpentane | 22.70 | 23.27 | 2.5 |

TABLE III

| FLUID | COKE AND SLUDGE FORMATION COKE | SLUDGE |
|---|---|---|
| Dexron Fluid | None | Medium |
| 2,4-dicyclohexyl-2-methylpentane | None | None |

TABLE IV

| FLUID | WEIGHT CHANGE OF METAL SPECIMENS ALUMINUM mg/cm² | IRON mg/cm² | COPPER mg/cm² | MAGNESIUM mg/cm² |
|---|---|---|---|---|
| Dexron Fluid | +0.02 | +0.01 | −0.49 | 0.00 |
| 2,4-dicyclohexyl-2-methylpentane | 0.00 | +0.01 | −0.01 | 0.00 |

From the data reported in Tables I through IV above, it will be seen that the synthetic fluid of the present invention, viz., 2,4-dicyclohexyl-2-methylpentane, gave results superior to those of the reference Dexron fluid. With particular reference to Table IV, it will be observed that the Dexron fluid exhibited a significant degree of copper corrosion as evidenced by a weight loss of 0.49 mg/cm² in the copper test specimen. The synthetic hydrocarbon 2,4-dicyclohexyl-2-methylpentane, on the other hand, showed practically no weight loss in the copper specimen with which it was in contact. These corrosion results are corroborated by the comparatively high total acid number ascribed to the Dexron fluid in the data of Table I.

Fluid viscosity is an important parameter in most power transmission systems, and especially in those systems wherein the fluid must perform under wide temperature variations. An automatic transmission fluid is required to meet certain initial viscosity standards, and it is desirable that any change in viscosity properties during use should be minimal. With reference to the results in Table II, it is observed that the Dexron fluid viscosity at 100° F. (37.8° C.) increased 87% during the 72 hour oxidation and corrosion test. This is contrasted with a viscosity increase of only 2.5% for 2,4-dicyclohexyl-2-methylpentane after 72 hours of exposure.

The Dexron fluid specification requires a minimum viscosity at 210° F. (98.9° C.) of 49.0 SUS, which is equivalent to 7.0 cs. It specifies a maximum Brookfield viscosity of 4000 cs. at −10° F. (−23.3° C.) and 55,000 cs. at −40° F. (−40° C.). The temperature viscosity data for 2,4-dicyclohexyl-2-methylpentane containing 3% cyclic dimer are as follows:

| Temperature ° F. | ° C. | Viscosity, cs. |
|---|---|---|
| −20 | −28.9 | 31,600 |
| 0 | −17.8 | 3,500 |
| 100 | 37.8 | 23 |
| 210 | 98.9 | 3.7 |

The addition of small amounts of a viscosity attenuator would be effective to reduce low temperature viscosity and conform 2,4-dicyclohexyl-2-methylpentane to the Dexron specification. Suitable attenuators include low viscosity compositions which are compatible with 2-4-dicyclohexyl-2-methylpentane, e.g., bicyclohexyl, isopropylbicyclohexyl, perhydrophenanthrene, and the like.

The addition of a minimal amount of a viscosity index improver would be effective to increase the high temperature viscosity to conform to the Dexron specification. Suitable V.I. improvers include the polyalkyl methacrylates in which the alkyl groups have from about 2 to 16 carbon atoms and may be, for example, ethyl, propyl, butyl, amyl, hexyl, etc., and mixtures thereof. The alkyl groups may be mixtures such as derived from a mixture of alcohols, and in which case there may be included some alkyl groups having as low as 1 carbon atom and as high as about 18 carbon atoms. The alkyl group is preferably a normal alkyl group but may be a branched chain or cycloalkyl group.

One example of a suitable V.I. improver for use with 2,4-dicyclohexyl-2-methylpentane and other fluids of this invention is a copolymer of butyl and lauryl methacrylate with a molecular weight of about 40,000. Another example is a terpolymer of butyl methacrylate, lauryl methacrylate, and vinyl pyrrolidone wherein the molecular weight is about 40,000. Still another V.I. improver is polyisobutylene prepared by acid-catalyzed polymerization of isobutylene up to a molecular weight between 20,000 and 40,000. Another is polyalkyl styrene prepared by polymerization of alkyl styrene, where the alkyl group is preferably lauryl, and the molecular weight is 45,000 to 50,000. Yet another V.I. improver useful in the present invention is a copolymer of vinyl acetate and alkyl fumarate having a molecular weight between 40,000 and 60,000. Alkyl acrylates such as ethyl acrylate and octyl acrylate may also be employed.

There are certain applications such as in automatic transmissions wherein additives other than viscosity index improvers and oxidation inhibitors are beneficial to the performance of the instant alkylene-linked cyclohexyl compounds. It may be desirable, for example, to add minor amounts of seal swellers, defoaming additives, antiwear additives, dispersants, dyes and other useful substances. It is to be understood, therefore, that those skilled in the art will visualize certain conventional additives which can be incorporated in the synthetic fluids taught by the present invention for the purpose of enhancing one or more fluid properties.

The oxidative stability of 2,4-dicyclohexyl-2-methylpentane as representative of the class of compounds taught by the present invention compares favorably with that of tetraalkyl substituted alkylene linked dicyclohexyl compounds such as 2,3-dicyclohexyl-2,3-dimethylbutane which are recognized for their exceptional oxidative stability, e.g., in U.S. Pat. No. 3,577,361 issued May 4, 1971. In an oxidation and corrosion test conducted according to the method previously described, the 100° F. (37.8° C.) viscosity increase and final acid number for these two fluids, each containing 1% 2,6-di-t-butyl-p-cresol, were as follows:

| | % Viscosity Increase | Final T.A.N. |
|---|---|---|
| 2,4-dicyclohexyl-2-methylpentane | 2.5 | 0.17 |
| 2,3-dicyclohexyl-2,3-dimethylbutane | 2.4 | 0.10 |

The excellent stability of 2,4-dicyclohexyl-2-methylpentane and the favorable comparison with 2,3-dicyclohexyl-2,3-dimethylbutane is most surprising on consideration of the chemical structure of this compound. The relationship of oxidation stability to compound type and structure is well recognized, and has been summarized for example by W. S. Dukek, J. Inst. Pet. 50, 276 (1964) as follows:

"Among hydrocarbons, alkyl aromatics are most easily oxidized, followed by diolefins, mono-olefins, and paraffins. Structure as well as type influence ease of oxidation. Tertiary hydrogen is most easily removed, followed by secondary and primary hydrogens. The resulting peroxides are stable in the same order."

In the case of the present compounds, 2,3-dicyclohexyl-2,3-dimethylbutane, has two tertiary hydrogen atoms attached to ring carbon atoms. The hydrogens, however, are shielded by the cyclohexyl groups and by the methyl groups on adjacent carbon atoms, and are accordingly protected from oxidation. The 2,4-dicyclohexyl-2-methylpentane, on the other hand, has three tertiary hydrogen atoms, one of which is attached to a bridging carbon atom. This additional tertiary hydrogen atom not only increases the potential for oxidation, but also reduces the degree of shielding afforded the tertiary hydrogen on the adjacent ring carbon atom. As a consequence, both these hydrogen atoms would be expected to be quite susceptible to oxidation, and it is quite surprising that, contrary to theory, 2,4-dicyclohexyl-2-methylpentane appears essentially equivalent to 2,3-dicyclohexyl-2,3-dimethylbutane in the above oxidation test.

An entirely unexpected characteristic of 2,3-dicyclohexyl-2,3-dimethylbutane has been discovered long after its recognition as a synthetic power transmission fluid. After long periods of storage at room temperature, it has been found that unformulated 2,3-dicyclohexyl-2,3-dimethylbutane tends to form crystals.

Thus, prior workers such as those in U.S. Pat. No. 3,577,361 were apparently able to record −20° F. (−28.9° C.) viscosity readings for unformulated and unblended 2,3-dicyclohexyl-2,3-dimethylbutane via normal test procedures on laboratory samples without recognizing or understanding that the material had supercooled during the sojourn to −20° F. (−28.9° C.).

For unexplained reasons, 2,4-dicyclohexyl-2-methylpentane of the present invention has shown no tendencies to exhibit the supercooling and latent crystallization properties of 2,3-dicyclohexyl-2,3-dimethylbutane of the prior art. This represents an unexpected, unobvious advantage of the synthetic fluids of the present invention.

The following example describes a method of preparing 2,4-dicyclohexyl-2-methylpentane, the preferred compound of the present invention having the chemical structure

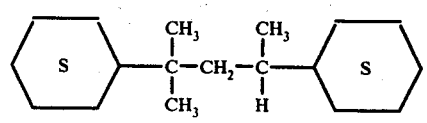

EXAMPLE I

A one liter autoclave was charged with 51 grams of Raney nickel catalyst and 600 grams of alpha-methylstyrene dimer which was a mixture of about 97% 2,4-diphenyl-4-methyl-1-pentene and 2,4-diphenyl-4-methyl-2-pentene dimers and 3% cyclic dimer. The catalyst was Raney No. 28 which had been prepared for the hydrogenation reaction by displacing the water with ethanol.

The autoclave was flushed with hydrogen and pressurized to 500 psig ($351.5 \times 10^3$ kg. per square meter). The reaction was maintained at about 60° C. and 500 psig with agitation for an initial reaction period of about 2 hours, following which the autoclave was slowly heated to 180° C. and maintained at that temperature for about 3 hours. The hydrogenation was completed by increasing the temperature to 200° C. at 500 psig for about 1 hour. Total reaction time was 4 hours.

After cooling and venting, the reaction product was removed from the autoclave and filtered. NMR analysis of the filtrate showed substantially complete hydrogenation of the unsaturated dimer with less than 0.1% unsaturation remaining. Low boilers were removed by a vacuum distillation to a head temperature of 135° C./0.9 mm. The hydrogenated product was a colorless oil having a refractive index, $n_D$ 1.4878.

Anal: Calc. for $C_{18}H_{34}$: C, 86.3: H, 13.7. Found: C, 86.0: H, 13.8.

The above example serves to illustrate one method whereby the fluids of the present invention are obtained by substantially complete hydrogenation of unsaturated linear dimers of alpha-alkyl styrene. In a like manner, 3,5-dicyclohexyl-3-methylheptane is obtained from linear dimer of alpha-ethylstyrene, and 3,5-dicyclohexyl-3-methylhexane and 2,4-dicyclohexyl-2-methylhexane are obtained from the linear co-dimer of alpha-methylstyrene and alpha-ethylstyrene, and the like.

By "substantially complete hydrogenation" of unsaturated linear dimers of alpha-alkyl styrene is meant that less than about 2%, and preferably less than 0.5% unsaturation remains after hydrogenation.

While the fluids of the present invention are useful per se as automatic transmission and hydraulic fluids, it may, for certain applications, be advantageous to employ for a base stock a blend or mixture of two or more of the synthetic compounds taught herein to obtain a desired balance of physical properties, and such mixtures are accordingly within the scope of this invention.

It may also be advantageous for certain uses to employ as the fluid base stock one or more of the compounds taught herein, in combination with one or more other synthetic fluids outside the scope of the present invention. Thus, the compounds of the present invention may be present as one component of a multicomponent complex fluid formulation. It is generally preferred that the fluids of the present invention comprise a major proportion, i.e., at least 50% by weight of the total fluid and more preferably at least about 65% by weight of the fluid composition. Other synthetic fluids which may be used in conjunction with the base stock fluids of the present invention may be for example tetraalkyl substituted alkylene linked dicyclohexyl compounds which are known to be suitable synthetic fluids for automatic transmissions.

Although 2,4-dicyclohexyl-2-methylpentane has been shown herein to have particular advantage as an automatic transmission fluid, the compound's utility is not so limited. The outstanding viscosity characteristics and oxidative stability of the compound make it a superior operating fluid in many other hydraulic systems and devices. A typical hydraulic system includes one or more displaceable members and a displacing force which is transmitted to said members by means of an operative fluid which is in communication therewith. While hydraulic systems will contain such elements as pumps, valves, cylinders, pistons and the like, the performance and endurance of the system necessarily depends upon the operative fluid. The viscosity characteristics of 2,4-dicyclohexyl-2-methylpentane make it advantageous for the transmission of power in a hydraulic system having a pump therein which supplies power for the system, e.g., in a fluid motor comprising a constant-discharge or variable-discharge piston pump which is caused to rotate by the pressure of the hydraulic fluid of the system. The preferred fluid likewise serves to lubricate the frictional parts of such hydraulic systems. The outstanding oxidative stability of 2,4-dicyclohexyl-2-methylpentane promotes cleanliness of a hydraulic system because of the resistance to sludge formation, deposits, corrosive attack and the like. The hydraulic systems envisioned in the present invention are understood to contain conventional fluid reservoir and fluid supply means.

The fluids employed in the present invention, therefore, are useful as hydraulic fluids in many types of hydraulic machines, e.g., lifts, hoists, jacks, lock-gates, presses, etc. They are likewise useful as the operative fluid in hydraulic steering mechanisms, wet clutches and other mechanical devices.

While this invention has been described with respect to certain specific embodiments, it is not so limited, and it is to be understood that variations amd modifications thereof may be made without departing from the spirit of the following claims.

The embodiments of this invention in which an exclusive property or privilege is claimed are defined as follows:

1. In a method of transmitting force in hydraulically operated mechanisms by the hydrokinetic action of a fluid composition, the improvement which comprises using a fluid composition comprising a major amount of hydrogenated dimers of $\alpha$-methylstyrene having less than about 2 percent unsaturation, the fully hydrogenated dimer consisting essentially of A. at least about 80 percent by weight of fully hydrogenated dimer of a linear dimer represented by the structure

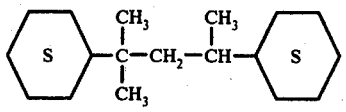

and

B. from 0 to about 20 percent by weight of fully hydrogenated dimer of a cyclic dimer represented by the structure

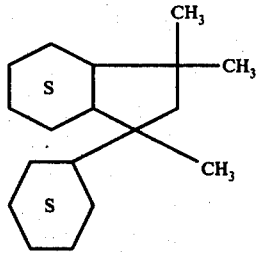

2. A method of claim 1 wherein the fully hydrogenated dimers consist essentially of from about 90% to about 100% by weight hydrogenated linear dimer of $\alpha$-methylstyrene and from 0% to 10% by weight cyclic dimers of $\alpha$-methylstyrene.

3. A method of claim 1 wherein the hydrogenated dimers are present in about 65% by weight of the fluid composition.

4. A method of claim 1 wherein the fluid composition contains a viscosity index improver in an amount effective to improve the viscosity index of said fluid composition.

* * * * *